United States Patent [19]

Lotufo

[11] Patent Number: 5,027,956

[45] Date of Patent: Jul. 2, 1991

[54] CARPET SAMPLE DISPLAY RACK

[75] Inventor: Robert J. Lotufo, Chattanooga, Tenn.

[73] Assignee: American Manufacturing Company, Chattanooga, Tenn.

[21] Appl. No.: 525,540

[22] Filed: May 18, 1990

[51] Int. Cl.[5] ..... A47F 7/00

[52] U.S. Cl. ..... 211/45; 211/50

[58] Field of Search ..... 211/45, 55, 50, 162, 211/11, 184; 108/60, 61

[56] References Cited

U.S. PATENT DOCUMENTS 1,074,796 10/1913 Jones ..... 211/162 X 1,881,614 10/1932 Irving ..... 211/11

4,697,710 10/1987 Gradecki et al. ..... 211/45

4,872,580 10/1989 Fuller et al. ..... 211/45

*Primary Examiner*—Alvin C. Chin-Shue

*Assistant Examiner*—Sarah A. Lechok

*Attorney, Agent, or Firm*—Luedeka, Hodges, Neely & Graham

[57] ABSTRACT

A carpet sample display rack having a support stand and divider units for supporting carpet samples positioned edgewise upon the stand utilizes linear and parallel U-shaped channels arranged so as to provide a guideway along which the divider units are slidably positioned. The channels capture the divider units in a manner which resists separation of the divider units from the stand and facilitates assembly of the rack.

11 Claims, 5 Drawing Sheets

CARPET SAMPLE DISPLAY RACK

BACKGROUND OF THE INVENTION

This invention relates generally to the displaying of carpet samples and relates more particularly to carpet display racks for supporting a plurality of carpet samples for easy viewing.

The type of display rack with which this invention is concerned includes a stand and at least one divider unit associated with the stand for supporting a plurality of carpet samples adjacent one another so that a substantial portion of each sample is exposed to view. The divider unit includes a base having an upper support surface and a plurality of spaced divider blades extending upwardly from the base upper surface so that when positioned between adjacent divider blades, the sample is positioned edgewise and in an upright condition within the rack. With the carpet samples supported in such a manner between the divider blades, each sample may be removed from the rack for inspection by simply lifting the sample from its position in the divider unit. An example of a rack of the aforedescribed type is shown and described in U.S. Pat. No. 4,872,580.

It is an object of the present invention to provide an improved carpet sample display rack of the aforedescribed type.

Another object of the present invention is to provide such a display rack having a stand and divider units which resist separation from one another when the rack is in an assembled condition.

Still another object of the present invention is to provide such a display rack which can be assembled with relative ease.

SUMMARY OF THE INVENTION

This invention is embodied in a carpet display rack including a support stand and at least one divider unit for supporting carpet samples positioned edgewise upon the stand. The stand includes means providing a pair of linear and parallel U-shaped channels arranged so that the "U" of one channel opens generally toward the "U" of the other channel to provide a guideway extending between opposite ends of the channels. The divider unit includes a base having an upper surface and a pair of opposite and parallel edges which are slidably received by the U-shaped channel so that the base can be slidably moved along the guideway to a predetermined position along the length of the channels. The divider unit further includes a plurality of spaced divider blades joined to the base so as to extend generally upwardly from the base upper surface so that the spacing provided between adjacent divider blades accepts a carpet sample placed edgewise therein.

DETAILED DESCRIPTION OF THE ILLUSTRATED EMBODIMENT

Figure 1:
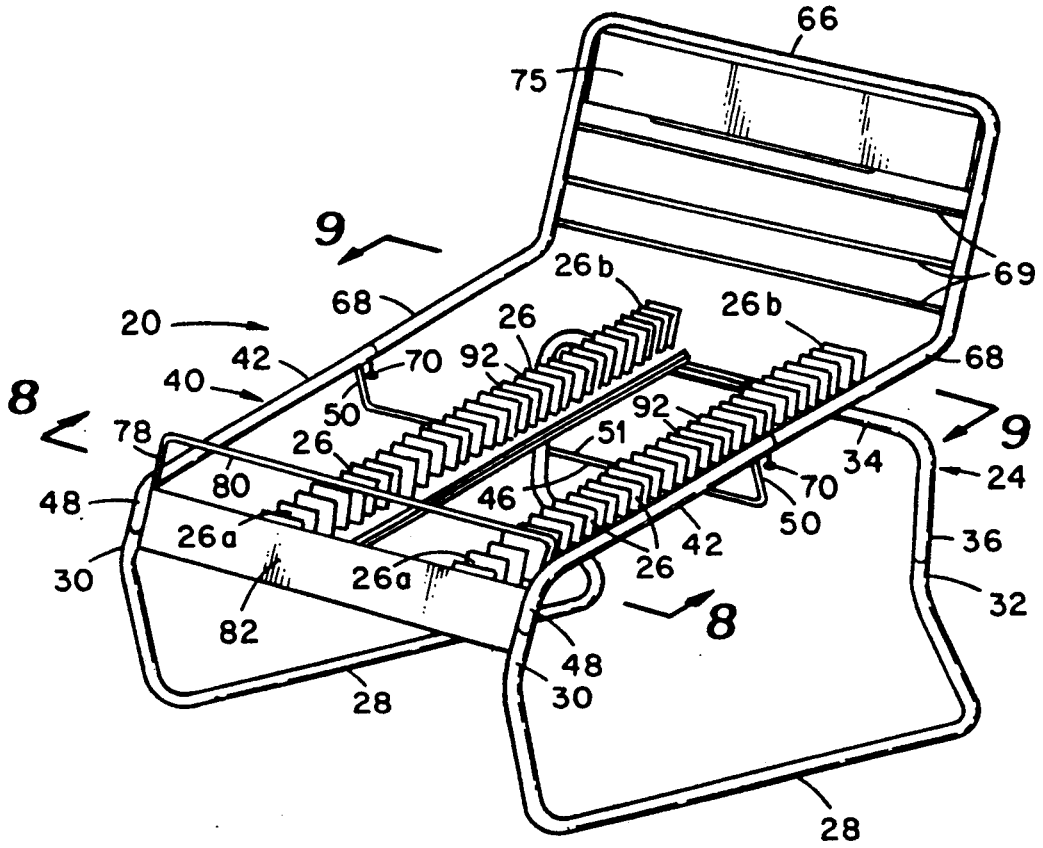
FIG. 1 is a perspective view of a carpet display rack embodying various features of the present invention.
Figure 2:
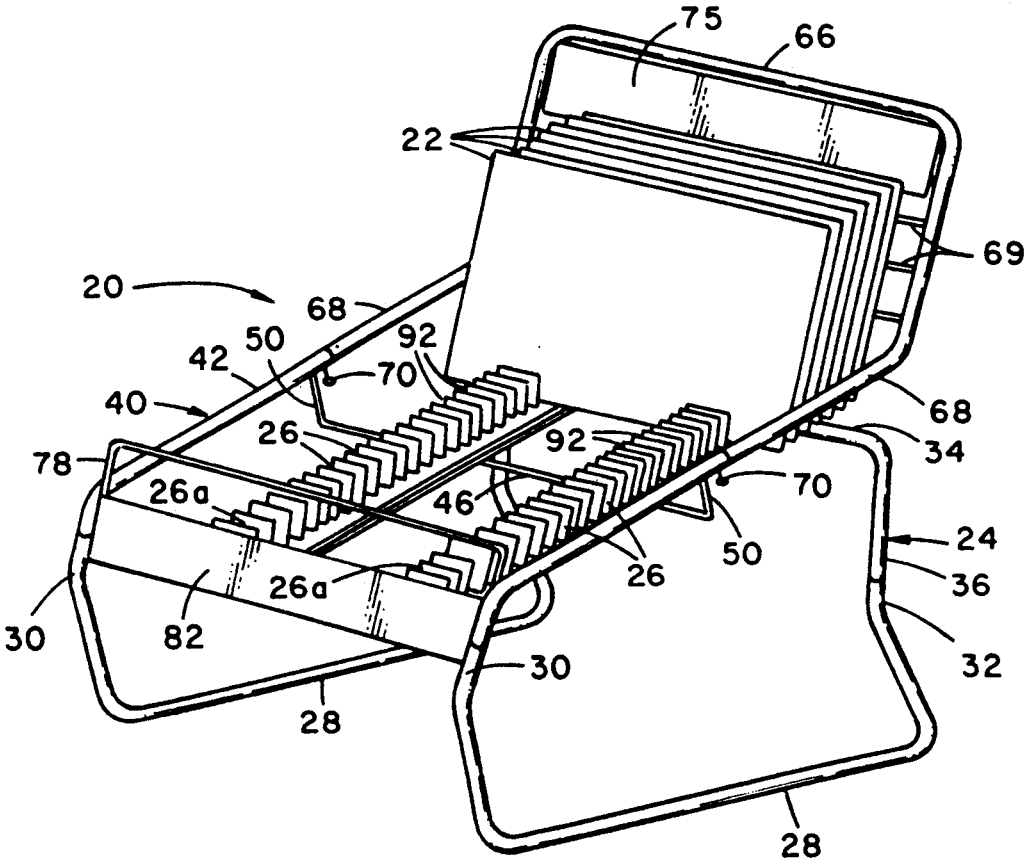
FIG. 2 is a perspective view similar to that of FIG. 1 illustrating the FIG. 1 rack when partially filled with carpet samples for viewing.

Turning now to the drawings in greater detail, there is illustrated in FIGS. 1 and 2 a display rack 20 utilized for displaying a plurality of carpet samples 22. Each carpet sample 22 displayed upon the rack 20 is generally rectangular in form and is supported edgewise and in an upright condition within the rack 20 so that an upper edge of each sample 22 may be easily viewed. In addition, each sample 22 may be removed from the rack 20 by simply lifting the sample 22 from the rack 20.

Figure 3:
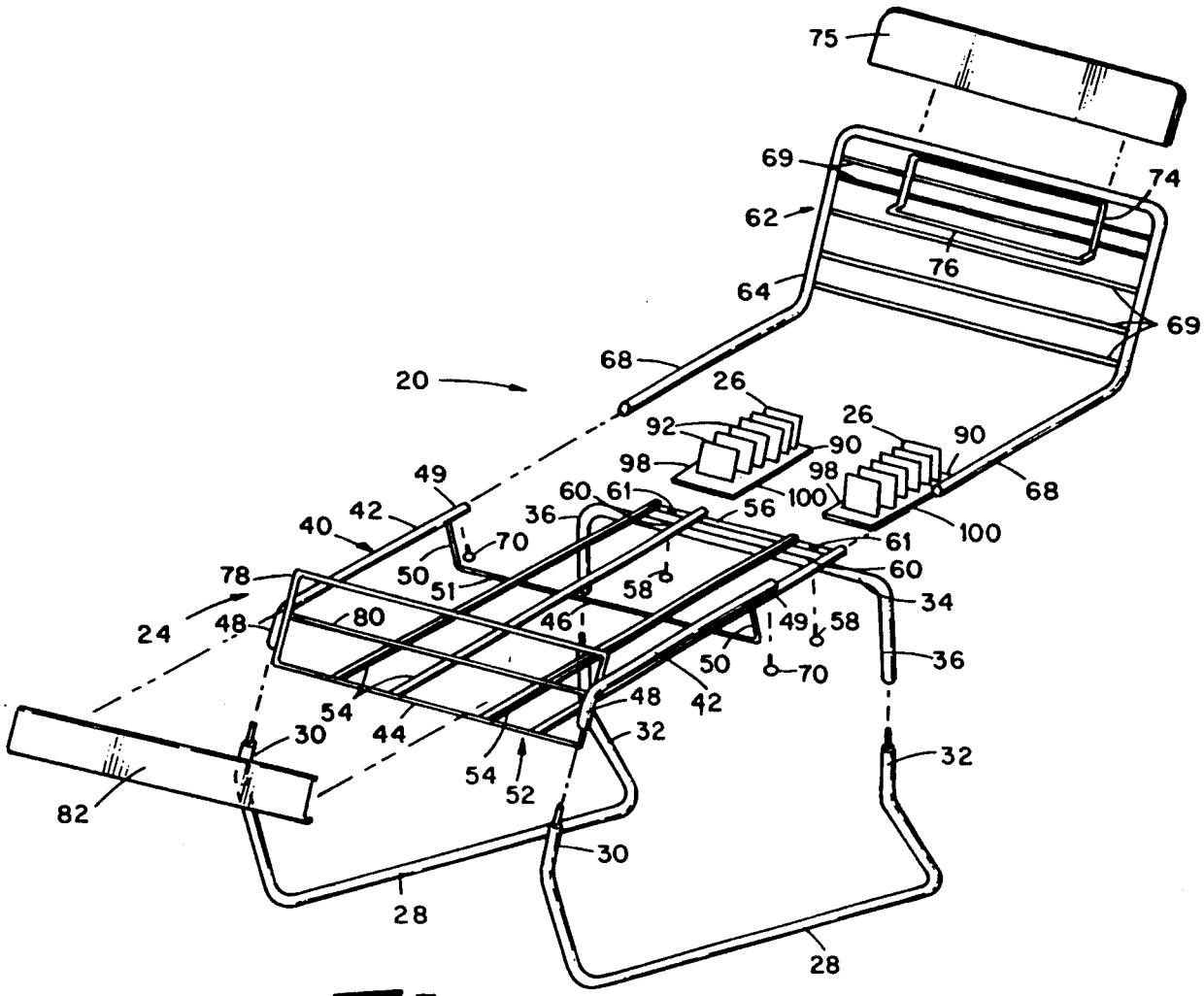
FIG. 3 is an exploded perspective view of the FIG. 1 rack.

The depicted display rack 20 includes a support stand 24 and ten divider units 26 mounted upon the stand 24 for supporting the samples 22 in an upright condition as aforedescribed. In the depicted rack 20, the support stand 24 is constructed of a suitable metal, such as steel, and each divider unit 20 is constructed of a relatively rigid plastic. As best shown in FIG. 3, the stand 24 includes a pair of tubular leg members 28 having upwardly-directed portions 30, 32 and a U-shaped tubular member 34 extending transversely of the rack 20 for joining the upwardly-directed portions 32 of the two leg members 28 adjacent the rear of the rack 20. The tubular member 34 includes downwardly-directed portions 36 which snugly interfit with the upwardly-directed portions 32 of the leg members 28 in a telescoping fashion to firmly join the leg members 28 together at the rear of the rack 20.

The stand 24 also includes a bed assembly 40 having a pair of tubular frame members 42 arranged so as to extend along opposite sides of the rack 20 and transversely-extending tubular members 44, 46 joining the frame members 42. Each of the frame members 42 includes generally downwardly-directed portions 48 which snugly interfit with the upwardly-directed portions 30 of the leg members 28 in a telescoping fashion to join the leg members 28 together at the front of the rack 20. Each frame member 42 also includes rearwardly-directed portions 49 whose purpose will be apparent herein. One transversely-extending tubular member 44 of the bed assembly 40 is straight along its entire length and is joined at its opposite ends, as with welds, to the frame members 42 adjacent the front of the rack 20. The other transversely-extending tubular member 46 of the bed assembly 40 is U-shaped in form having a straight section 51 and a pair of upwardly-directed leg sections 50 joined to the opposite ends of the straight section 51 and fixedly attached to the frame members 42 adjacent the rear of the rack 20, as with welds.

Figure 4:
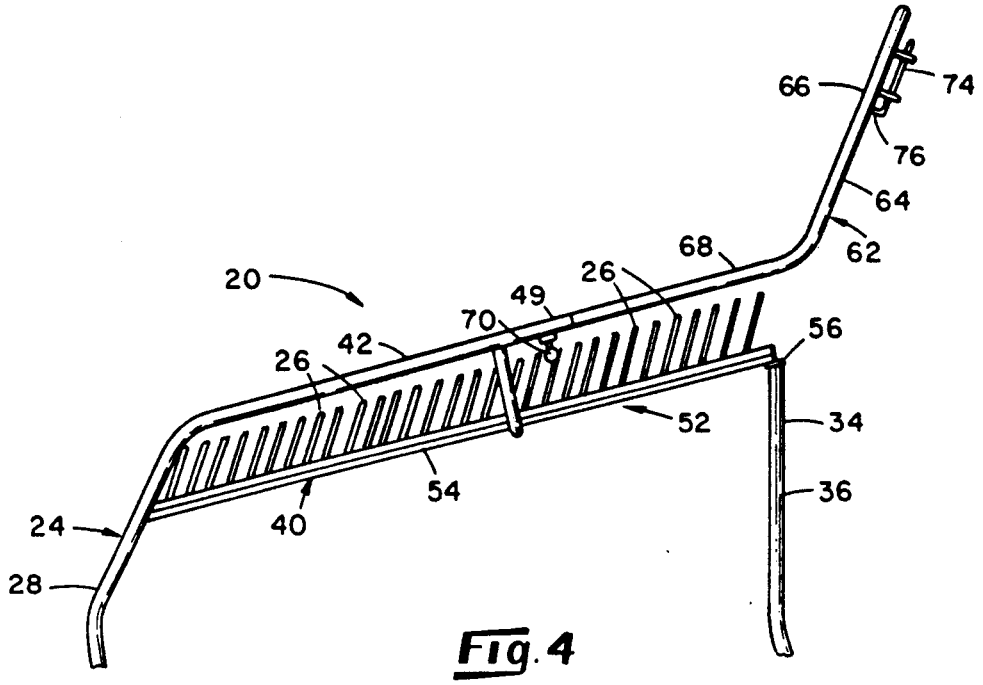
FIG. 4 is a fragmentary side elevational view of the FIG. 1 rack.

The bed assembly 40 also includes a channel assembly 52 affixed to the transversely-extending tubular members 44, 46 so as to extend from the front to the rear of the rack 20 and in a canted relationship with respect to the horizontal, as best shown in FIG. 4. The channel assembly 52 includes two sets of parallel runners, or channels 54, which are directly joined at one end to the transversely-extending tubular member 44 adjacent the front of the rack 20. The channels 54 are joined together adjacent the rear of the rack 20 by means of an elongated bar 56 which extends transversely across the rack 20. More specifically, each end of the channels 54 adjacent the rear of the rack 20 overlies and is fixedly secured to the bar 56, as with welds. When the stand 24 is assembled, the bar 56 overlies the U-shaped tubular member 34 and is joined thereto by means of bolts 58 or other similar fasteners which extend through suitable apertures 60 (FIG. 9) provided in the tubular members 34 and which are threadably received by aligned apertures 61 provided along the bar 56.

It follows that with the U-shaped tubular member 34 joined to the upwardly-directed portions 32 of the leg members 28, and the bed assembly 40 joined to the upwardly-directed portions 30 of the leg members 28 and the tubular member 34 in the aforedescribed manner, the bed assembly 40 is rigidly supported in an elevated condition. As will be apparent herein, the bed assembly 40 provides a support plane upon which the bottom edges of the carpet samples rest when positioned within the divider units 26 and which is sloped from back-to-front along the rack 20 as best shown in FIG. 4.

To provide a back for the rack 20, the stand 24 includes a header assembly 62 which spans the width of the rack 20 adjacent the rear thereof. As best shown in FIG. 3, the header assembly 62 includes a tubular member 64 having a U-shaped rear section 66 and a pair of forwardly-directed leg portions 68 joined to the rear section 66 in the manner shown. Five transversely-extending tubes 69 are joined, as with welds, at opposite ends to the legs of the rear section 66 to provide a canted support for the back of the carpet samples 22. The leg portions 68 of the tubular member 64 are adapted to interfit with the rearwardly-directed portions 49 of the bed assembly frame members 42 in a telescoping fashion so that the frame members 42 slidably accept the leg portions 68. Thumb screws 70 are threadably accepted by suitable openings defined in the bed assembly frame members 42 and tightenable against the leg portions 68. To adjust the distance that the rear section 66 of the header assembly 64 is spaced from the front of the display rack 20, the thumb screws 70 are loosened and the leg portions 68 are slidably moved along the length of the bed assembly frame members 42. The thumb screws 70 are then tightened to releasably secure the leg portions 68 in position within the frame members 42.

If desired, a tubular frame 74 forming a shelf 76 may be incorporated into the header assembly 62 for providing a support for a display sign 75 (FIG. 3) adjacent the rear of the rack 20. In addition, a tubular support frame 78 having traversely-extending tubes 80 may be incorporated into the bed assembly 40 as best shown in FIG. 3 for supporting a display sign (not shown) adjacent the front of the rack 20. The support frame 78 provides an additional advantage in that it provides a front stop, or support, for carpet samples 22 positioned upon the divider units 26 and which may be leaned forwardly by a prospective customer as he examines the samples 22 in the rack 20. For providing a flat surface against which the front display sign may be mounted, there is provided a transparent plastic member 82 of rigid construction adapted to be releasably attached in a snap-fit relationship to the transversely-extending tubes 80 of the support frame 78.

Figure 5:
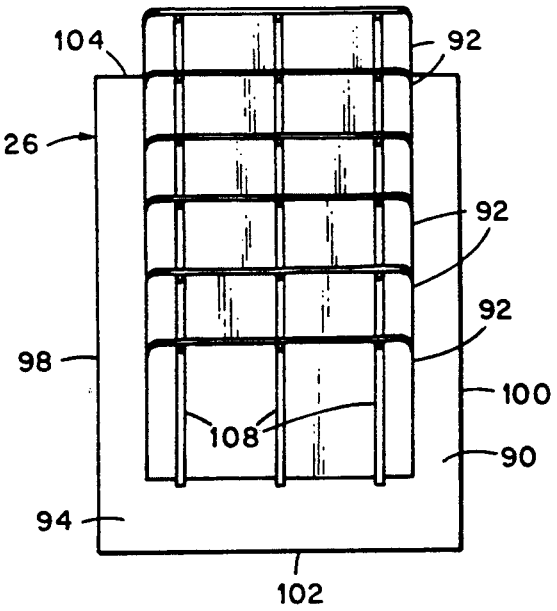
FIG. 5 is a top plan view of one of the divider units of the FIG. 1 rack.
Figure 7:
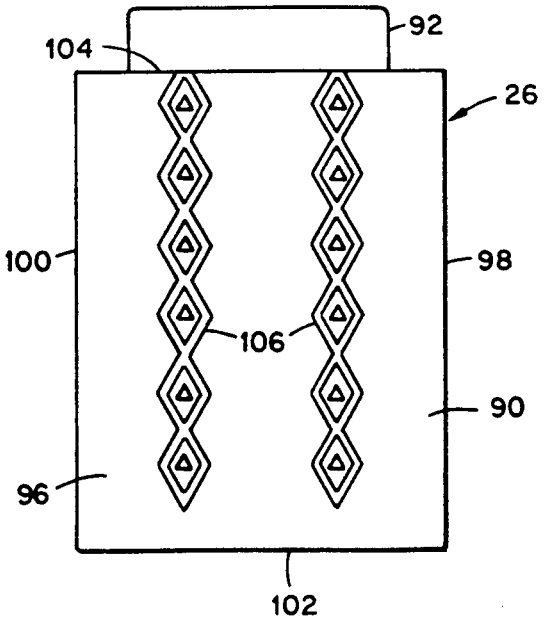
FIG. 7 is a bottom plan view of the divider unit of FIG. 5.
Figure 6:
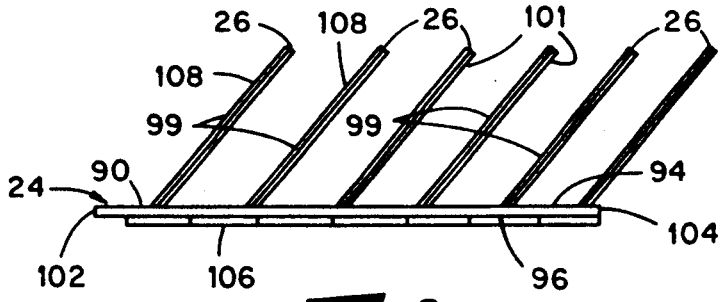
FIG. 6 is a side elevational view of the divider unit of FIG. 5.

With reference to FIGS. 5–7, each divider unit 26 of the display rack 20 includes a substantially planar base 90 and six divider blades 92 joined to the base 90. The base 90 defines substantially rectangular top and bottom surfaces 94, 96, respectively, opposite and parallel side edges 98, 100 and opposite and parallel front and rear edges 102, 104, respectively. The divider blades 92 are arranged in a parallel and spaced relationship as best viewed in FIG. 6 and extend generally upwardly from the base 90 so as to form an angle with the base top surface 94.

To enhance the stiffness and strength of each divider unit 24, stiffening ribs 106, 108 are formed in the base 90 and blades 92, respectively, as best shown in FIGS. 5 and 7. The stiffening ribs 108 formed in the base 90 are provided only in the bottom surface 96 thereof so that its top surface 94 remains smooth. Similarly, the stiffening ribs 108 formed in each blade 92 are provided only in its forwardly-directed surface, indicated 99, so that its rearwardly-directed surface, indicated 101, remains smooth. When each sample 22 is positioned between two divider blades 92 so that the upper, or decorative side, of the sample 22 faces forwardly, the decorative side and lower edge of the sample 22 contacts the top surface 94 of the base 90 and the rearwardly-directed surface 101 of one of the divider blades 26. Because these divider unit surfaces 94 and 101 are smooth, there is little likelihood that the decorative side or lower edge of the sample 22 will experience any damage due to the contact with the surfaces 94, 101, and the smooth surfaces 94, 101 are advantageous in this respect.

Figure 8:
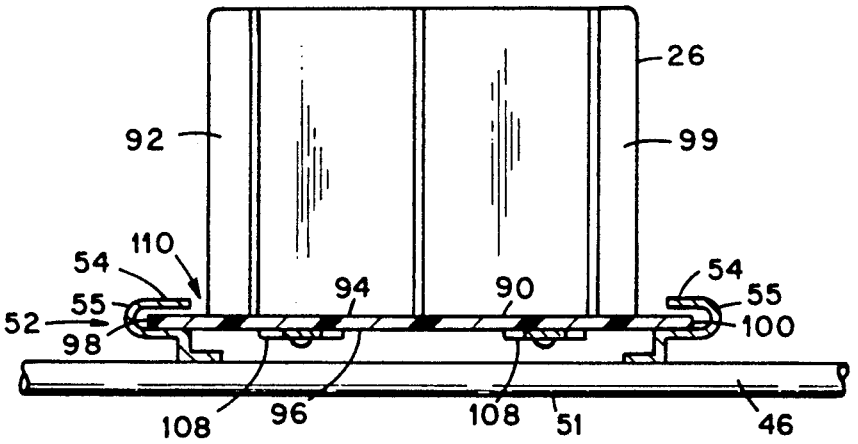
FIG. 8 is a cross-sectional view taken along line 8—8 of FIG. 1.

It is a feature of the present invention that the divider units 26 and stand 24 cooperate with one another in a manner which facilitates the putting together of the rack 20. To this end, the channels 54 in each set of channels 54 include portions 55 of U-shaped cross section and are arranged in the bed assembly 40 so that the "U" of each channel portion 55 opposes the "U" of the other channel portion 55 as illustrated in FIG. 8 and so as to provide a guideway, indicated as 110, for slidably receiving the divider units 26. With the divider units 26 positioned within the guideway 110, the "U" of each channel 54 slidably accepts a corresponding side edge 98 or 100 of the divider unit base 90.

To position the divider units 26 within the guideway 110, each divider unit 26 is inserted front-end first through the spacing provided between the channels 54 adjacent the rear of the rack 20. With the base edges 98, 100 accepted by the opposing channels 54 as aforedescribed, the divider units 26 may be slidably moved relative to and along the length of the channels 54 to predetermined positions therealong. When positioning the divider units 26 within the rack 20, each divider unit 26 is inserted within a corresponding one of the sets of channels 54 so that the units 26 are positioned in an end-to-end arrangement from one end, or forward end, of the channels 54 to the other end, or rearward end, of the channels 54. In the depicted rack 20, each set of channels 54 is sized to hold five divider units 26 positioned end-to-end.

Figure 9:
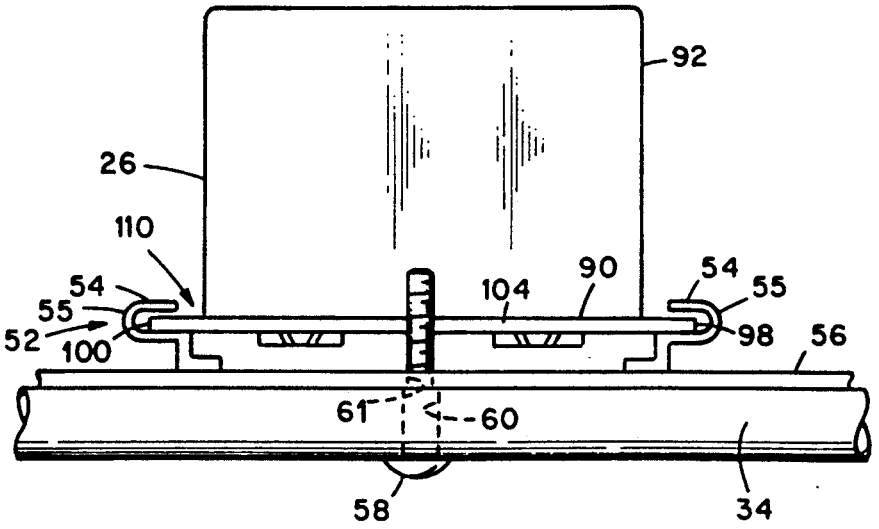
FIG. 9 is a fragmentary elevational view as seen along line 9—9 of FIG. 1.

With reference again to FIG. 3, the forward ends of the channels 54 are positioned so as to abut the tubular member 44 of the bed assembly 40. The tubular member 44 thus provides a stop, or abutment surface, at the lower end of the channels 54 against which the front of the forwardmost divider units, indicated as **26*a* in FIG. 1, rest when positioned within the rack 20. For preventing the divider units 26 from being withdrawn from the channels 54 at the rear of the rack 20, each bolt-receiving aperture 61 provided in the bar 56 of the bed assembly 40 is located midway between the channels 54 in a corresponding channel set as best shown in FIG. 9. Therefore, when each bolt 58 is tightened within its aperture 61, its shank extends upwardly between the channels 54 so as to be positioned between the rear of the rearwardmost divider units, indicated as 26***b* in FIG. 1, and the rearward ends of the channels 54. The shank of each bolt 58 thus provides a removable stop member for preventing the removal of divider units 26 through the spacing provided at the rearward channel ends. With the divider units 26 thereby captured between the tubular member 44 and the shanks of the bolts 58, the divider units 26 cannot be removed from either the forward or rearward end of the channels 54.

It follows from the foregoing that the spacing provided between the channels 54 at the rear of the rack 20 can be opened by backing each bolt 58 out of its corresponding aperture 61 until the aforementioned channel spacing is unobstructed by the bolt shank. The divider units 26 are inserted one-at-a-time between the channels 54 through the aforementioned channel spacing until each guideway 110 is substantially filled with the divider units 26. The bolts 58 can then be retightened within the apertures 61 to prevent the divider units 26 from being withdrawn from the channels 54. It also follows that the aforedescribed cooperation between the bed assembly 40 and the divider units 26 prevent the divider units 26 from separating from the channels 54 during use and during some instances of misuse. If, for example, the display rack 20 is roughly jostled, knocked over, or the divider units 26 are pulled upon, the divider units 26 remain captured within the channels 54. Thus, once the rack 20 is assembled, the divider units 26 resist separation from the stand 24, and the rack 20 is advantageous in this respect.

The rack 20 provides a further advantage in that its support frame 78 positioned adjacent the front of the rack 20 is disposed in such a relation to the forward edge of the forwardmost divider units 26*a* (FIG. 2) that the lower edge of a carpet sample 22, i.e., the front sample, may be positioned across the bases 90 of the divider units 26*a* and generally between the frame 78 and the forwardmost blade of the divider units 26*a* so that the sample 22 is supported upright within the rack 20. In other words, the lower edge of a carpet sample 22 resting across the forward edge of the forwardmost divider units 26*a* is prevented from slipping off of the forward edge and out of the rack 20 by the support afforded the sample 22 by the frame 78 so that any need for a divider blade 92 positioned forwardly of the front sample 22 is circumvented. The appearance of the support frame 78 for supporting the front sample in an upright condition is preferred over the appearance of a blade 92 or the like positioned forwardly of the front sample.

To use the rack 20 and with reference again to FIG. 1, carpet samples 22 are placed upon the divider units 26 so that the lower edge of each sample 22 is positioned between adjacent divider blades 92. In order that the header assembly 62 provides stability to the back of the carpet samples 22 as the rack 20 is loaded with samples 22, it is preferred that the carpet samples 22 be positioned within the rack 20 from the rear of the rack toward the front thereof. Because the divider units 26 are arranged in a canted orientation with respect to the horizontal, the upper edge portion of each sample 22 positioned within the rack 20 may be easily viewed as shown in FIG. 2. Removal of a carpet sample 22 from the rack 20, such as may be required if a perspective purchaser desires to more thoroughly examine a sample 22 or take a sample 22 home for inspection, a sample 22 is simply lifted from between the corresponding divider blades 92 of the divider unit 26.

It will be understood that numerous modifications and substitutions may be made to the aforedescribed embodiment 20 without departing from the spirit of the invention. Accordingly, the aforedescribed rack 20 is intended for the purpose of illustration and not as limitation.

I claim:

1. A carpet sample display rack comprising:

a support stand including means providing a pair of linear and parallel U-shaped channels arranged in a side-by-side relationship so that the "U" of each U-shaped channel opens generally toward the "U" of the other U-shaped channel to provide a guideway extending along the length of the channels;

at least one divider unit for supporting carpet samples positioned edgewise upon the rack, the divider unit including a base having an upper surface, a pair of opposite and parallel side edges which are slidably received by the U-shaped channels so that the divider unit base can be slidably moved along the guideway to a predetermined position along the length of the channels and a pair of opposite and parallel end edges which extend between the side edges, the divider unit further including a plurality of spaced divider blades joined to the base so as to extend generally upwardly from the base upper surface and so that the spacing provided between adjacent divider blades accepts a carpet sample placed edgewise therein;

the U-shaped channels being configured so that each side edge of the divider unit base received by a U-shaped channel is captured within the U of the channel and is prevented from moving laterally with respect to the guideway by the cooperation between each side edge of the divider unit base and the U-shaped channel within which the edge of the divider unit base is received and so that the only permitted movement of the divider unit relative to the channels is movement of the divider unit longitudinally along the channels; and a first stop means associated with one pair of ends of the channels for cooperating with an end edge of the divider unit base to prevent movement of the divider unit out of the guideway between the one pair of channel ends and a second stop means associated with the other pair of ends of the channels for cooperating with the other end edge of the divider unit base to prevent movement of the divider unit out of the guideway between the other pair of channel ends so that the divider unit base is bodily captured between the first and second stop means.

2. The display rack as defined in claim 1 wherein the first stop means is movable from a first position at which the guideway is closed off at said one pair of channel ends and a second position at which the guideway is open at said one pair of channel ends to accommodate movement of the divider unit into and out of the guideway at said one pair of channel ends.

3. The display rack as defined in claim 2 wherein each channel end in said one pair of channel ends is supported by an elongated support member extending transversely of the channels and the first stop means includes a stop member supported by the support member for movement into and out of the spacing provided between the channels at said one pair of channel ends for selectively opening and closing off the guideway at said one pair of channel ends.

4. The display rack as defined in claim 3 wherein the support member includes a internally-threaded opening along its length and the stop member is a shanked fastener which is threadably received by the internally-threaded opening for movement into and out of the channel spacing as aforesaid as the fastener is rotated in one rotational direction and then the other rotational direction within the support member opening.

5. The display rack as defined in claim 1 wherein the pair of linear and parallel U-shaped channels is a first pair and the support stand includes a second pair of linear and parallel U-shaped channels arranged like the channels of the first pair and adjacent and parallel to the first pair, and the display rack includes a divider unit having base edges which are slidably received by each pair of U-shaped channels, each divider unit including divider blades having spacings therebetween which correspond to the spacings provided between the divider blades of the other divider unit so that a carpet sample may be placed edgewise between adjacent divider blades of both divider units.

6. The display rack as defined in claim 1 wherein the base of each divider unit has a length as measured along each of its side edges, the length of each divider unit base being substantially smaller than the length of the channels, and the display rack includes a plurality of divider units positioned along the guideway so that the guideway is substantially filled with divider units.

7. The display rack as defined in claim 1 wherein the base of the divider unit includes at least one stiffening rib formed therein for enhancing the strength of the base.

8. The display rack as defined in claim 7 wherein the divider unit base includes opposite top and bottom surfaces, and the base top surface is relatively smooth as a path is traced between the opposite edges of the base.

9. The display rack as defined in claim 1 wherein each divider blade of the divider unit extends across the base for a substantial portion of the width of the base and includes at least one stiffening rib formed therein for enhancing the strength of the divider unit.

10. The display rack as defined in claim 9 wherein each divider unit blade includes opposite forwardly-facing facing and rearwardly-facing surfaces and opposite side edges, and the rearwardly-facing surface of each blade is relatively smooth as a path is traced between the opposite side edges of the blade.

11. The display rack as defined in claim 1 having a front and a rear, the divider blades extend generally traversely of the rack and the rack further includes a support frame disposed generally forwardly of the divider unit in such a relation to the forwardmost divider blade of the unit that a carpet sample positioned within the rack generally between the support frame and the forwardmost blade of the divider unit is maintained by the support frame in an upright condition within the rack.

* * * * *